US008357814B2

(12) United States Patent
Demura et al.

(10) Patent No.: US 8,357,814 B2
(45) Date of Patent: Jan. 22, 2013

(54) METHOD OF PURIFYING INTERESTERIFIED OILS

(75) Inventors: Mitsuru Demura, Chuo-ku (JP); Shuichi Abe, Kawasaki (JP)

(73) Assignee: Mizusawa Industrial Chemicals, Ltd. (JP)

( * ) Notice: Subject to any disclaimer, the term of this patent is extended or adjusted under 35 U.S.C. 154(b) by 174 days.

(21) Appl. No.: 12/929,526

(22) Filed: Jan. 31, 2011

(65) Prior Publication Data

US 2011/0124895 A1 May 26, 2011

(30) Foreign Application Priority Data

Jul. 31, 2008 (JP) ..... 2008-197352

(51) Int. Cl.
*C11B 3/00* (2006.01)

(52) U.S. Cl. ..... 554/193; 554/191

(58) Field of Classification Search ..... 554/191, 554/193

See application file for complete search history.

(56) References Cited

FOREIGN PATENT DOCUMENTS

JP 07310090 A * 11/1995

* cited by examiner

*Primary Examiner* — Deborah D Carr
(74) *Attorney, Agent, or Firm* — H. Jay Spiegel

(57) ABSTRACT

[Problems] To provide a method of purifying interesterified oils, which is capable of efficiently purifying the interesterified oil through a series of steps effectively solving a problem of decreased oxidation stability of the interesterified oil that is purified and a problem of color tone.

[Means for Solution] Water is added and mixed into an interesterified oil of animal/vegetable fat and oil in an amount of 0.30 to 5.0 parts by weight per 100 parts by weight of the interesterified oil, followed by dehydration. Thereafter, a decolorizing treatment is conducted by adding an adsorbent thereto, and filtration is conducted to remove soaps, an alkali catalyst and the adsorbent contained in the interesterified oil.

4 Claims, No Drawings

METHOD OF PURIFYING INTERESTERIFIED OILS

TECHNICAL FIELD

This invention relates to a method of purifying interesterified oils. More particularly, the invention relates to a method of purifying interesterified oils that are formed at the time of reforming fat and oil by interchanging esters in the molecules or among the molecules of fat and oil.

BACKGROUND ART

As a technology for chemically reforming fat and oil, the technology of interchanging esters in or among the molecules of fat and oil, that is, recombining fatty acid to reform fat and oil has been widely utilized along with the reforming technology based on the hydrogenation. The reforming technology of interchanging esters has been applied to, for example, the production of edible oils.

The interesterified oils that are formed by the above reforming are, usually, colored and from which the residual catalyst and the by-produced soaps must be removed. For this purpose, a decolorizing treatment has been conducted by using a variety of adsorbents.

For instance, a patent document 1 discloses an art of interesterifying animal/vegetable fat and oil, readily adding water thereto to thereby inactivate the catalyst and liberate the by-produced soaps as hydrates, removing the soaps by centrifugation or filtration, and removing the remaining soaps from the interesterified oils by washing with water.

Further, a patent document 2 discloses an art of adding 3% of water to an interesterified oil to liberate the soaps as hydrates, removing the soaps by centrifugation, conducting the washing with water and, thereafter, conducting the decolorizing treatment by using an adsorbent.

Patent document 1: JP-B-57-61797 (page 1, col. 1, line 2 from bottom to col. 2, line 6)

Patent document 2: JP-B-53-38084 (page 3, col. 6, lines 2-9)

DISCLOSURE OF THE INVENTION

Problems that the Invention is to Solve

As described in the patent documents 1 and 2, there have been known methods of liberating the soaps by adding water, removing the soaps by centrifugation, conducting the washing with water and, thereafter, conducting the decolorization by using an adsorbent. These methods have an advantage of effectively preventing the adsorbent from losing the adsorbing performance caused by soaps. To remove the soaps, however, a treating solution must be introduced into a centrifuge making it difficult to conduct the treatment in a series of steps and greatly lowering the treating efficiency. Another defect is that the soaps in the interesterified oil cannot be completely removed by centrifugation alone, and the treated solution after centrifugation must be washed with water.

When the liberated soaps are to be removed by washing with water only without conducting the centrifugation, water is required in large amounts still causing the production efficiency to become poor.

At present, further, attempts have been made to add an aqueous solution of an inorganic acid or an organic acid such as citric acid to the interesterified oil to convert the soaps contained as by-products in the interesterified oil and the alkali catalyst into fatty acids and a salt of the inorganic acid or the organic acid, followed by dehydration to precipitate crystals of the inorganic acid salt or the organic acid salt, and to effect the decolorizing treatment in this state by using an adsorbent. According to this method, however, the coloring components that have precipitated together with the soaps dissolve again in the oil deteriorating the color tone of the oil and making it difficult to remove the coloring components with the adsorbent in a subsequent step, leaving a problem in that the color tone is deteriorated after the decolorizing treatment. As a result, it is considered that properties such as oxidation stability and the like are further deteriorated.

The present invention, therefore, provides a method of purifying interesterified oils, which is capable of efficiently purifying the interesterified oil through a series of steps effectively solving a problem of decreased oxidation stability of the interesterified oil that is purified and a problem of color tone.

Means for Solving the Problems

According to the present invention, there is provided a method of purifying interesterified oils comprising following steps of:

adding and mixing water into an interesterified oil of animal/vegetable fat and oil in an amount of 0.30 to 5.0 parts by weight per 100 parts by weight of the interesterified oil;

conducting the dehydration;

conducting a decolorizing treatment by adding an adsorbent after the dehydration has been finished; and conducting the filtration after the decolorizing treatment to remove soaps, an alkali catalyst and the adsorbent contained in the interesterified oil.

According to the present invention, it is desired that:

(1) The amount of water that is added is from 0.50 to 2.5 parts by weight per 100 parts by weight of the interesterified oil;

(2) Water is added and mixed while heating the interesterified oil at a temperature of 30 to 80° C.; and (3) At least either an activated clay or a silica-magnesia is used as the adsorbent.

Effects of the Invention

In the present invention, the decolorizing treatment with an adsorbent and the subsequent filtration can be conducted in the same manner as the widely known method. Here, however, an important feature resides in that water is added to the interesterified oil that is to be treated and, next, the added water is dehydrated and removed prior to conducting the decolorizing treatment by using the adsorbent.

The step in which water is once added and is, thereafter, dehydrated and removed would appear to be a quite wasteful. Due to the addition and dehydration of water, however, the soaps contained in the interesterified oil as by-products cohere and grow into large particles. As a result, even when the decolorizing treatment is conducted by using an adsorbent without removing the soaps, it does not happen that the soaps are trapped in the pores of the adsorbent. Therefore, a decrease in the adsorbing performance of the adsorbent is effectively prevented, and the decolorization with the adsorbent can be effectively executed. Besides, the soaps grow into coarse particles, do not cause the filtering performance to deteriorate, and can, therefore, be easily separated away together with the used adsorbent by filtration after the decolorizing treatment has been finished.

Besides, in the present invention, water needs be added in small amounts since it is not used for washing away the water-soluble components such as soaps; i.e., water is added in an amount of about 0.30 to about 5.0 parts by weight and, particularly, about 0.50 to about 2.5 parts by weight per 100 parts by weight of the interesterified oil that is to be treated. Therefore, quite unlike the case of washing with large amounts of water, there is required no particular facility for treatment with water and, besides, the dehydration is easily conducted by heating in the same batch under reduced pressure, making it possible to carry out in a series the steps of addition of water, dehydration, decolorization with an adsorbent and filtration in the same batch. It will, therefore, be understood that the purifying treatment of the present invention is very highly efficient and productive.

Further, the present invention effectively prevents such problems as a decrease in the oxidation stability and coloration of the interesterified oil that is purified. That is, in the present invention, particles of soaps simply grow without accompanied by such reactions as neutralization of the soaps containing coloring components or solubilization of the soaps in oil again. Therefore, there occur no such problems as coloration or a decrease in the oxidation stability that stem from the solubilization of soaps containing coloring components in oil.

BEST MODE FOR CARRYING OUT THE INVENTION

<Interesterified Oils>

The interesterified oil to be put to the purifying method of the present invention is obtained by subjecting the animal/vegetable oil comprising chiefly a fatty acid and a glycerin to the interesterification that has been known per se. By interchanging acyl groups through the interesterification, various properties are reformed enabling the method to be widely applied to reforming, particularly, edible oils.

Though there is no particular limitation, examples of the animal/vegetable oils to be put to the interesterification include, as vegetable oils, safflower oil, soybean oil, rape oil, palm oil, palm kernel oil, cotton seed oil, coconut oil, rice bran oil, sesame oil, castor oil, linseed oil, olive oil, tung oil, tsubaki oil, peanut oil, kapok oil, cacao oil, Japan wax, sunflower oil and corn oil and, as animal oils, fish oil, whale oil, beef tallow, lard, mutton tallow and beef foot oil.

The interesterification of the animal/vegetable oils is conducted by using an alkali catalyst, i.e., an alkoxide such as sodium methoxide or potassium methoxide. Here, prior to the interesterification, it is important to deoxidize and dehydrate the animal/vegetable oil so that, for example, free fatty acid is adjusted to be not more than 0.2% by weight and water concentration to be not more than 100 ppm. That is, the presence of free fatty acid and water causes the alkali catalyst to lose its activity. The dehydration is easily conducted by heating under reduced pressure.

The interesterification is conducted by adding the alkali catalyst to the animal/vegetable oil that has been deoxidized and dehydrated as described above. Here, the alkali catalyst is added, usually, in an amount of about 0.1 to about 0.5 parts by weight per 100 parts by weight of the fat and oil.

The interesterifications by adding the alkali catalyst include the one based on the interchange of fatty acid in or among the molecules of fat and oil (usually applied to the production of edible oils), the one based on the substitution reaction (alcoholysis) by the addition of lower alcohols such as methanol, ethanol, etc. (usually applied to the production of bio fuels), and the one based on the substitution reaction (acidolysis) by the addition of a fatty acid such as stearic acid or the like acid. The interesterified oil may be produced relying upon any interesterification. In the interesterification based on the interchange of a fatty acid in or among the molecules, therefore, the interesterification continues after the addition of the alkali catalyst.

The above interesterification is, usually, conducted under normal pressure by being heated at a temperature of about 50 to 90° C. with stirring for, generally, about 10 to about 60 minutes though it may differ depending upon the mode of interesterification.

<Purifying Treatment>

The interesterified oil obtained as described above contains catalyst residues and soaps (alkali metal salts of fatty acid) which are the by-products as well as coloring components such as pigments contained in the starting animal/vegetable oil. Therefore, these impurities are removed through the purifying treatment of the invention.

Here, the purifying treatment chiefly comprises the decolorizing treatment using an adsorbent and the filtration. Prior to these treatments according to the present invention, however, water is, first, added and is, next, dehydrated. The addition of water and the dehydration are for coarsening the particles of soaps contained in the interesterified oil. That is, when the decolorizing treatment is conducted by using the adsorbent that will be described later, soaps that are present are adsorbed and held in the pores which are the adsorption sites of the adsorbent causing the pores to be closed and resulting in a great decrease in the adsorbing performance of the adsorbent. Upon coarsening the particles of soaps, however, the soaps are effectively prevented from entering into pores in the adsorbent making it possible to effectively avoid a decrease in the adsorbing performance of the adsorbent caused by soaps. Besides, the soaps that have been coarsened can be easily separated by the subsequent filtration.

Described below is a principle in which the particles of soaps are coarsened by the addition of water and by the dehydration. Namely, upon adding water, the hydrophilic molecules of soaps are trapped by water that is added, and a number of molecules of soaps are suspended in water. Upon conducting the dehydration in this state, many molecules of soaps precipitate in a cohered state forming coarse particles of soaps.

According to the present invention, water needs be added in very small amounts, preferably, in an amount in a range of 0.30 to 5.0 parts by weight and, particularly, 0.50 to 2.5 parts by weight per 100 parts by weight of the interesterified oil unlike the case of removing the soaps by washing with water. If water is added in an amount in excess of the above range, the soaps that are contained work as an emulsifier causing the interesterified oil to become an emulsion which may accelerate the hydrolysis of oil and fat. Besides, the dehydration requires an extended period of time which is not desirable from the standpoint of production efficiency and consumption of energy. If water is added in too small amounts, on the other hand, the particles of soaps are not coarsened to a sufficient degree making it difficult not only to sufficiently suppress a decrease in the performance of the adsorbent caused by soaps but also to separate the particles of soaps by filtration.

Further, to effectively coarsen the particles of soaps, water is gradually added with mild stirring so that water comes in sufficient contact with the soaps contained in the interesterified oil and that the soaps are suspended in whole amounts in water. For example, if water is added at one time with vigorous stirring, then emulsion that entraps the interesterified oil forms easily. Concrete rate of addition and stirring conditions can be suitably set depending upon the amount of water to be added and the capacity of the reaction vessel for conducting the treatment. Further, the water can be added and mixed while suitably heating the interesterified oil that is to be treated. Upon adding water which is heated at a temperature of, for example, about 30 to about 80° C., the time for mixing can be shortened. Usually, when the water is added while the interesterified oil being heated in the above temperature range, the time for mixing after the whole amount of water is added is about 10 to about 60 minutes. If the temperature of water that is added is lower than 30° C., it becomes difficult to mix the water and the interesterified oil together, and the particles of soaps are little coarsened. If the temperature of water is higher than 80° C., water tends to be volatilized before coming in contact with the interesterified oil.

The dehydration may be effected by heating. To effect the dehydration in a short period of time in particular, it is desired that water is volatilized by heating under reduced pressure. In general, the dehydration is effected by heating at about 50 to about 80° C. under a pressure of not higher than 1.3 kPa abs. In this case, the dehydration time of about 30 minutes is sufficient. If the temperature of the dehydration treatment is lower than 50° C., an extended period of time is required for the dehydration treatment. If the temperature of dehydration treatment is higher than 80° C., the quality of the purified oil decreases.

After the water is added and dehydrated as described above, an adsorbent is added to effect the decolorizing treatment in a customary manner. As the adsorbent, for instance, there can be used the one that has heretofore been used for the decolorizing treatment of this kind, such as activated carbon, activated clay, silica-magnesia or silica. Among them, activated clay or silica-magnesia is desired.

The activated clay is obtained by treating the smectite clay such as acid clay or bentonite with an acid; i.e., the smectite clay is treated with a solution of a mineral acid such as sulfuric acid or hydrochloric acid to partly elute out the basic components contained therein, followed by washing. The treatment with the acid partly destroys the lamellar crystal structure inherent in the acid clay causing, however, the content of silicic acid ($SiO_2$) to increase and the specific surface area to increase contributing to improving properties such as adsorbing capability. The activated clay that is particularly preferably used, usually, has the following composition though it may vary depending on the kind of the starting clay and the conditions of treatment with acid.

Chemical Composition of the Activated Clay (Acid Clay Treated with an Acid):

$SiO_2$: 65.0 to 83.0% by weight
$Al_2O_3$: 5.0 to 12.0% by weight
$Fe_2O_3$: 1.0 to 3.5% by weight
MgO: 1.0 to 7.0% by weight
CaO: 0.5 to 4.0% by weight
$K_2O$: 0.2 to 2.0% by weight
$Na_2O$: 0.2 to 2.0% by weight
Ig. loss: 5.0 to 10.0% by weight Among the above activated clays, particularly those having BET specific surface areas of 200 to 500 $m^2/g$ and porous volumes in a range of about 0.3 to about 0.6 ml/g exhibit excellent adsorbing performance (decolorizing performance) and are preferably used in the present invention. The above activated clay has been placed on the market by the present applicant in the trade name of Galleon Earth.

As the silica-magnesia, further, there can be preferably used the one that contains a silica component and a magnesia component at a ratio ($SiO_2$/MgO) of 0.1 to 50 calculated as oxides and has a BET specific surface area of not less than 100 $m^2/g$ and, particularly, not less than 300 $m^2/g$. The above silica-magnesia has been placed on the market by the present applicant in the trade name of Mizukalife.

Further, the silica that is preferably used has a BET specific surface area of not less than 300 $m^2/g$. The above silica has been placed on the market by the present applicant in the trade name of Mizukasorb S-0.

The above adsorbent is added in the form of a powder or particles, and effectively adsorbs coloring components such as coloring matters together with other low molecular impurity components that are contained in trace amounts to thereby effectively accomplish the decolorization. The amount of the adsorbent to be used varies depending on its kind and properties such as specific surface area and particle size, and cannot be exclusively specified but is, usually, in a range of about 1.0 to about 5.0 parts by weight calculated as an anhydride thereof per 100 parts by weight of the interesterified oil.

Further, the decolorizing treatment is conducted by mixing and stirring the above adsorbent and the interesterified oil together. In order to efficiently conduct the decolorizing treatment within short periods of time, however, they are usually mixed and stirred being heated at a temperature of about 90 to about 120° C. under a reduced pressure (usually, not higher than 1.3 kPa abs.) for, generally, about 10 to about 30 minutes though they may vary depending on the amount to be treated and the kind and amount of the adsorbent.

The interesterified oil to be treated contains soaps that are by-produced through the interesterification. As described already, however, the soaps are assuming the form of coarse particles through the preceding steps, and a decrease in the performance of the adsorbent caused by soaps is effectively avoided.

After the decolorizing treatment is conducted as described above, the used adsorbent is separated by filtration, and the interesterified oil is obtained in a purified form. The soaps are assuming the form of coarse particles and other impurity components have also been adsorbed and held by the adsorbent. Therefore, the components are reliably separated together with the adsorbent by filtration from the interesterified oil that is purified.

The filtration can be conducted by means known per se. by using a filtering paper or a filtering cloth, or by using any filtering machine such as filter press, belt filter, Oliver filter, American filter or centrifugal filter.

According to the above purifying method of the present invention, the treatment is conducted without forming fatty acid or the like that stem from the decomposition of, for example, soaps. Therefore, the interesterified oil after purified is effectively prevented from being colored and features a high oxidation stability. Namely, the interesterified oil obtained after the purifying features properties comparable to those of the interesterified oil that is decolorized with an adsorbent after having removed the soaps by washing with large amounts of water.

There is conducted no washing with large amounts of water, and a very little load is exerted by the treatment with water. Further, soaps are not removed by centrifugation in the intermediate stage but are removed by the final filtration together with the used adsorbent. Besides, there is no need of conducting the separation by extraction. The interesterification through up to the filtration can be conducted through a series of steps in, for example, one batch. Therefore, the purifying can be conducted maintaining a very high production efficiency in a period of time that is strikingly shortened as compared to the traditional methods offering a great industrial advantage.

The present invention can be effectively applied, particularly, to the production of edible oils.

EXAMPLES

The invention will now be concretely described by way of the following Examples (Experiments) only to which, however, the invention is in no way limited. The testing methods conducted in Examples were as described below. Further, parts in Examples are all by weight per 100 parts by weight of the interesterified oil.

(1) Evaluating the Filterability.

The filterability was tested under the following conditions.

Amount of the decolorized oil: 200 g

Funnel used: ϕ7.0 cm (filtering area, 38.5 $cm^2$)

Sucking pressure: 21.3 kPa abs.

Measuring the filtering time: Time was measured from the start of pouring the decolorized oil until there was no oil in the filter cake.

Standards for evaluating the filterability:

10 minutes or shorter: good 10 to 30 minutes: slightly poor 30 minutes or longer: poor (2) Evaluating the Color Tone:

The color tone of the oil was measured concerning R-value and Y-value in compliance with the Lovibond method specified by the Standard Method of Analyzing Fat and Oil (2.2.1.1-1996). Table shows values 10R+Y. The glass cells were $5_{1/4}$ inches.

(3) Amount of Soaps in the Oil:

The amount of soaps in the oil was measured in compliance with the Standard Method of Analyzing Fat and Oil (2.6.2-1996).

(4) Testing the Oxidation Stability:

The oxidation stability was measured in compliance with the CDM test specified by the Standard Method of Analyzing Fat and Oil (2.5.1.2-1996). The oil was heated at a temperature of 120° C.

Experiment 1

To 200 g of an RBD (refined bleached deodorized) palm oil, there was added 0.15 parts of a sodium methoxide (first class grade chemical: produced by Wako Pure Chemical Industries, Ltd.) as a catalyst to effect the interesterification according to a known method. One part of ion-exchanged water was added to the interesterified oil heated at 80° C. and was mixed therein for 10 minutes. Next, the dehydration was conducted under reduced pressure of a vacuum degree of about 0.67 kPa at 80° C. for 30 minutes to coarsen the particles of the suspended substances (soaps containing coloring components). Thereafter, 3.0 parts of an activated clay (Galleon Earth V2, produced by Mizusawa Industrial Chemicals, Ltd.) was added thereto to conduct the decolorizing treatment under reduced pressure of a vacuum degree of about 0.67 kPa at 100° C. for 15 minutes, and the solid components were removed by filtration to obtain a decolorized oil.

180 Grams of the decolorized oil was subjected to the deodorizing treatment with steam at 230° C. for 2 hours under reduced pressure of a vacuum degree of 0.67 kPa to obtain a purified oil. The purified oil was subjected to the above-mentioned various tests to obtain results as shown in Table 1.

Experiment 2

Experiment 1 was repeated but using silica-magnesia (Mizukalife F-1G; $SiO_2$/MgO mass ratio=2.03, BET specific surface area, 720 $m^2$/g: produced by Mizusawa Industrial Chemicals, Ltd.) as activated clay for the decolorization. The purified oil was subjected to the above-mentioned various tests to obtain results as shown in Table 1.

Experiment 3

Experiment 1 was repeated but adding water heated at 50° C., effecting the mixing for 30 minutes and using silica (Mizukasorb S-0; BET specific surface area, 550 $m^2$/g: produced by Mizusawa Industrial Chemicals, Ltd.) as activated clay for the decolorization. The purified oil was subjected to the above-mentioned various tests to obtain results as shown in Table 1.

Experiment 4

Experiment 1 was repeated but adding 0.25 parts of ion-exchanged water to the interesterified oil. The purified oil was subjected to the above-mentioned various tests to obtain results as shown in Table 1.

Experiment 5

Experiment 1 was repeated but adding 0.50 parts of ion-exchanged water to the interesterified oil. The purified oil was subjected to the above-mentioned various tests to obtain results as shown in Table 1.

Experiment 6

Experiment 1 was repeated but adding 2.5 parts of ion-exchanged water to the interesterified oil. The purified oil was subjected to the above-mentioned various tests to obtain results as shown in Table 1.

Experiment 7

Experiment 1 was repeated but adding 5.0 parts of ion-exchanged water to the interesterified oil. The purified oil was subjected to the above-mentioned various tests to obtain results as shown in Table 1.

Experiment 8

Experiment 1 was repeated but adding 6.0 parts of ion-exchanged water to the interesterified oil. Here, the color tone of the oil has changed due to the addition and mixing of water, and the tendency toward emulsion was exhibited. Further, a very extended time was required for the dehydration.

Experiment 9

To 200 g of the RBD palm oil, there was added 0.15 parts of the sodium methoxide as a catalyst to effect the interesterification according to a known method. Upon maintaining the interesterified oil at 50° C., hot water heated at 50° C. was added in an equal amount thereto to wash with hot water. The oil of the upper layer washed with water was recovered, and to which was added again the hot water in an equal amount to wash with hot water in the second time. The recovered oil that has been washed with water was subjected to the decolorizing and deodorizing treatments like in Experiment 1 to obtain a purified oil. The purified oil was subjected to the above-mentioned various tests to obtain results as shown in Table 1.

Experiment 10

To 200 g of the RBD palm oil, there was added 0.15 parts of the sodium methoxide as a catalyst to effect the interesterification according to a known method. Upon maintaining the interesterified oil at 80° C., a citric acid was added thereto in the form of an aqueous solution of 10% of citric acid in an amount 1.3 times as large as the chemical equivalent of the sodium methoxide put to the reaction in order to carry out the neutralization treatment for 30 minutes. Next, the dehydration was conducted under reduced pressure of a vacuum degree of 0.67 kPa at 80° C. for 30 minutes followed by the decolorizing and deodorizing treatments like in Experiment 1 to obtain a purified oil. The purified oil was subjected to the above-mentioned various tests to obtain results as shown in Table 1.

TABLE 1

| | | Decolorized oil | | | Purified oil | |
|---|---|---|---|---|---|---|
| | Water (wt. pts.) | Filter ability | Lovibond value*1 | Soaps in oil (ppm) | Lovibond value*1 | CDM (h) |
| Exp. 1 | 1.0 | good | 29 | ND*2 | 24 | 10.7 |
| Exp. 2 | 1.0 | good | 38 | 5 | 27 | 10.6 |
| Exp. 3 | 1.0 | good | 43 | ND | 28 | 9.5 |
| Exp. 4 | 0.25 | slightly poor | 62 | 11 | 35 | 8.5 |
| Exp. 5 | 0.50 | good | 28 | ND | 24 | 10.2 |
| Exp. 6 | 2.5 | good | 27 | ND | 24 | 10.6 |
| Exp. 7 | 5.0 | good | 31 | ND | 25 | 9.4 |
| Exp. 9 | — | good | 33 | ND | 28 | 8.9 |
| Exp. 10 | — | good | 44 | ND | 36 | 8.1 |

*1Value 10R + Y

*2Less than detectable limit.

The invention claimed is:

1. A method of purifying interesterified oils comprising following steps of:

adding and mixing water into an interesterified oil of animal/vegetable fat and oil in an amount of 0.30 to 5.0 parts by weight per 100 parts by weight of said interesterified oil;

conducting the dehydration;

conducting a decolorizing treatment by adding an adsorbent after said dehydration has been finished; and conducting the filtration after the decolorizing treatment to remove soaps, an alkali catalyst and the adsorbent contained in said interesterified oil.

2. The purifying method according to claim 1, wherein the amount of water that is added is from 0.50 to 2.5 parts by weight per 100 parts by weight of the interesterified oil.

3. The purifying method according to claim 1, wherein said water is mixed while heating the interesterified oil at a temperature of 30 to 80° C.

4. The purifying method according to claim 1, wherein at least either an activated clay or a silica-magnesia is used as said adsorbent.

* * * * *